US005097913A

United States Patent [19]

Lennart Gustafsson

[11] Patent Number: 5,097,913

[45] Date of Patent: Mar. 24, 1992

[54] PORTABLE PERCUSSIVE MACHINE

[75] Inventor: Klas R. Lennart Gustafsson, Kalmar, Sweden

[73] Assignee: Berema Aktiebolag, Solna, Sweden

[21] Appl. No.: 604,766

[22] Filed: Oct. 26, 1990

[30] Foreign Application Priority Data

Oct. 28, 1989 [SE] Sweden ..... 8903621

[51] Int. Cl.[5] ..... B25D 9/02

[52] U.S. Cl. ..... 173/210; 173/200; 173/202

[58] Field of Search ..... 173/112, 118, 119, 116, 173/128, 134, 135, 139, 131; 92/85 A

[56] References Cited

U.S. PATENT DOCUMENTS

| | | | |
|---|---|---|---|
| 3,642,077 | 2/1972 | Bayard | 173/116 |
| 3,650,336 | 3/1972 | Koehler | 173/116 |
| 4,069,876 | 1/1978 | Pototsky et al. | 173/119 |
| 4,109,734 | 8/1978 | Montabert | 173/131 |
| 4,203,446 | 5/1980 | Höfert et al. | 173/139 |
| 4,231,434 | 11/1980 | Justus | 173/119 |
| 4,308,926 | 1/1982 | Montabert | 173/139 |
| 4,549,344 | 10/1985 | Nikolich | 173/139 |
| 4,582,144 | 4/1986 | Mizutani | 173/116 |
| 4,609,053 | 9/1986 | Ragnmark | 173/119 |
| 4,611,670 | 9/1986 | Chromy | 173/104 |

*Primary Examiner*—Frank T. Yost
*Assistant Examiner*—Scott A. Smith
*Attorney, Agent, or Firm*—Eric Y. Munson; Mark P. Stone

[57] ABSTRACT

A percussive machine comprises a housing (10) with a cylinder (11) therein, in which a reciprocating drive piston (40) via a gas cushion in a working chamber (44) repeatedly drives a hammer piston (15) to impact on the neck (17) of a tool (20) carried by the housing (10). At empty blows with the neck (17) out of reach, the hammer piston (15) is thrown forwardly and caught pneumatically in a braking chamber (47) at the bottom end (12) of the cylinder (11). The braking is combined with an elastic yielding of the bottom end (12) against the action of a recoil spring (23) in the housing (10). The pressure in the braking chamber (47) during such yielding is controlled by throttling apertures (48) in the cylinder (11) uncovered by the bottom end (12). The hammer piston (15) is thus checked to halt pneumatically by throttling avoiding a collision with the bottom end (12) and takes an inactive position below ports (46) in the cylinder wall through which the working chamber (44) is relieved and ventilated. The bottom end (12) is returned upon yielding by the recoil spring (23) and closes the throttling apertures (48) by check valve action.

8 Claims, 4 Drawing Sheets 36
37
34
35
32
43
33
11
42
53
40
44
45
16
14
52
46
10
47
13
15
12
23
28
27
17
38
29
19
18
21
20
51

PORTABLE PERCUSSIVE MACHINE

BACKGROUND OF THE INVENTION

The present invention relates to portable percussive machines of the type comprising a housing with a cylinder therein, in which a reciprocating drive piston via a gas cushion in a working chamber repeatedly drives a hammer piston to impact on the neck of a tool carried by the housing, and in which the hammer piston at empty blows is displaced towards the bottom end of the cylinder past ports in the cylinder wall through which said gas cushion is relieved so as to inactivate the hammer piston.

Percussive machines of the above type are usually hand held and used primarily for chiseling or drilling, powered by a suitable motor. Particularly in the higher power range of such tools suitable for instance for breaking, there is accentuated the problem that, if during full power operation the tool unexpectedly happens to slip aside from or to meet a crevice in the object operated upon, the hammer piston often will make a sudden empty blow of such strength that metallic collision thereof against the bottom end can occur with resultant risk of damage. The excessive heat generated in case pneumatic braking is practiced is liable to weaken the hammer piston seal, and a leaking or worn piston ring is certain to worsen the harmful effect of powerful empty blows.

SUMMARY OF THE INVENTION

It is an object of the invention to assure in percussive machines of the above type that damages following from empty blows are avoided and the energy of motion of the hammer piston is successfully checked without regard to when during different type of work an empty blow happens to occur. These objects are attained by the characterizing features of the appended claims.

BRIEF DESCRIPTION OF THE DRAWINGS

The invention is described in more detail with reference to the accompanying drawings. Therein

DESCRIPTION OF THE BEST MODES FOR CARRYING OUT THE INVENTION

Figure 1:
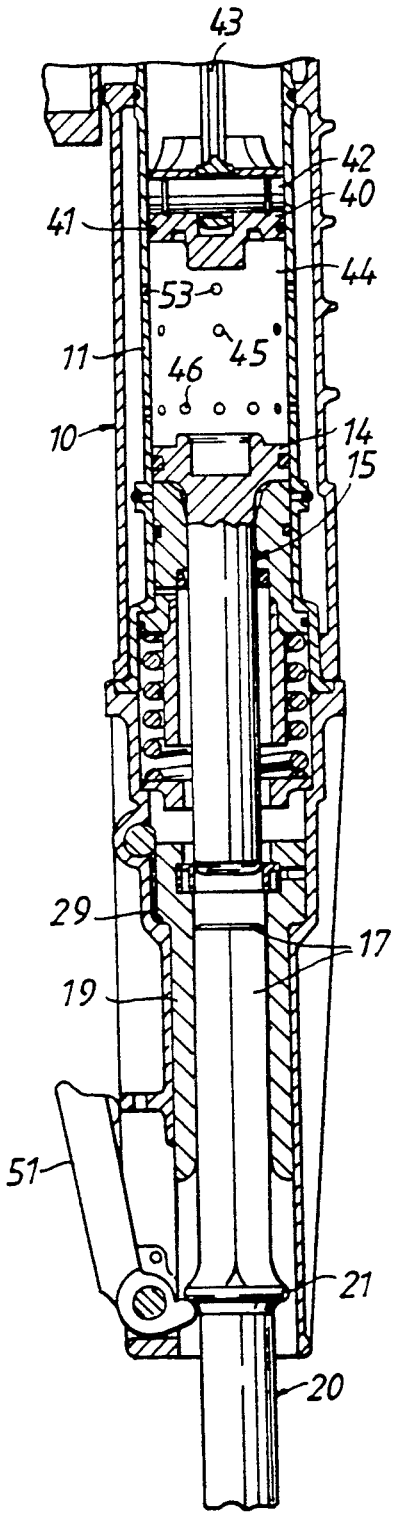
FIG. 1 shows a longitudinal partial section through a percussive machine embodying the invention, shown with its hammer piston in inactive position.
Figure 2:
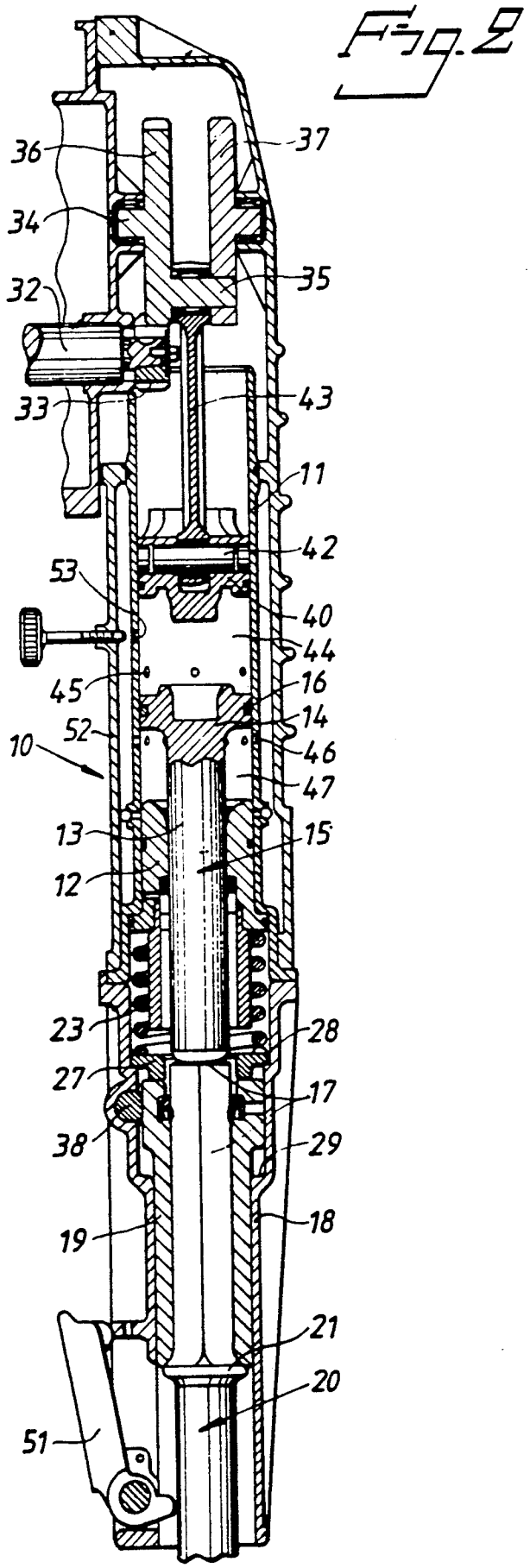
FIG. 2 shows a corresponding view with the hammer piston in idle or tool applying position.

The percussive machine comprises a hand held machine housing 10 with a cylinder 11, in which a preferably differential hammer piston 15 is slidably guided and sealed by a piston ring 16 surrounding the piston head 14. The piston rod 13 passes slidably and sealingly through the bottom end or piston guide 12 and delivers impacts against the neck 17 of a tool 20, for example a pick, chisel, tamper or drill, which by a collar 21 rests axially against a tool sleeve 19 and is slidably guided therein. The sleeve 19 in its turn is axially slidably guided in the frontal end 18 of the housing 10, and when the work so demands is prevented from rotating by slidable contact of a plane surface thereon with a flattened cross pin 38 in the end 18. In the working position of FIG. 2 the sleeve 19 abuts against a spacing ring 27. A recoil spring 23 is pre-stressed between a shoulder 24 on the bottom end 12 and the spacer ring 27, urging the latter onto an inner shoulder 28 in the frontal end 18 (FIGS. 3B). The pre-compression of the preferably helical spring 23 is such as to balance the weight of the machine when the latter is kept standing on the tool 20 as depicted in FIG. 2. When the machine is lifted from such position, the tool sleeve 19 will sink down to inactive position against an abutment shoulder 29 in the frontal end 18, while the sinking movement of the tool 20 continues and is stopped by the collar 21 being arrested by the stop lever 51, FIG. 1. Simultaneously therewith the hammer piston 15 sinks down taking its inactive position in the foremost part of the cylinder 11.

The housing 10 comprises a motor, not shown, which, depending on the intended use, may be a combustion engine, an electric motor or a hydraulic motor. The motor drives a shaft 32 and a gear wheel 33 thereon is geared to rotate a crank shaft 34 journalled in the upper part of the machine housing 10. The crank pin 35 of the crank shaft 34 is supported by circular end pieces 36,37 of which one is formed as a gear wheel 36 driven by the gear wheel 33. A drive piston 40 is slidably guided in the cylinder 11 and similarly to a compressor piston sealed thereagainst by a piston ring 41. A piston pin 42 in the drive piston 40 is pivotally coupled to the crank pin 35 via a connecting rod 43. Between the drive piston 40 and the hammer piston head 14 the cylinder 11 forms a working chamber 44 in which a gas cushion transmits the movement of the drive piston 40 to the hammer piston 15.

Figure 3A:
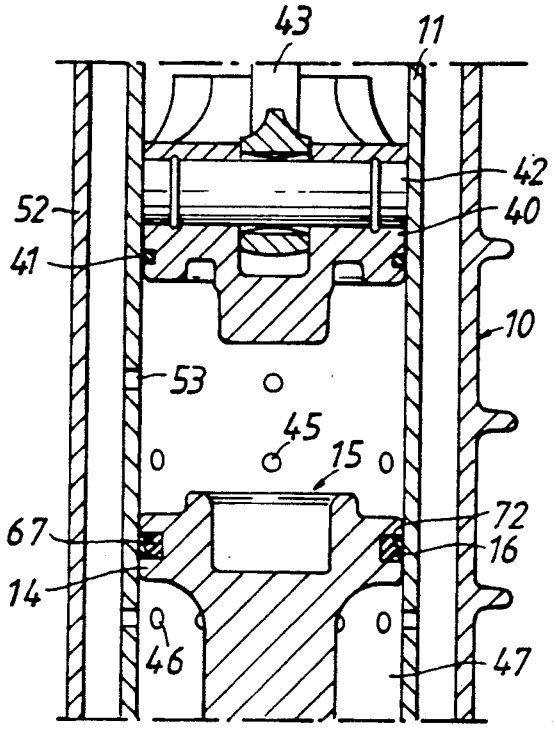
FIG. 3A is an enlarged section of the rear part of the impact motor in FIG. 2.
Figure 3B:
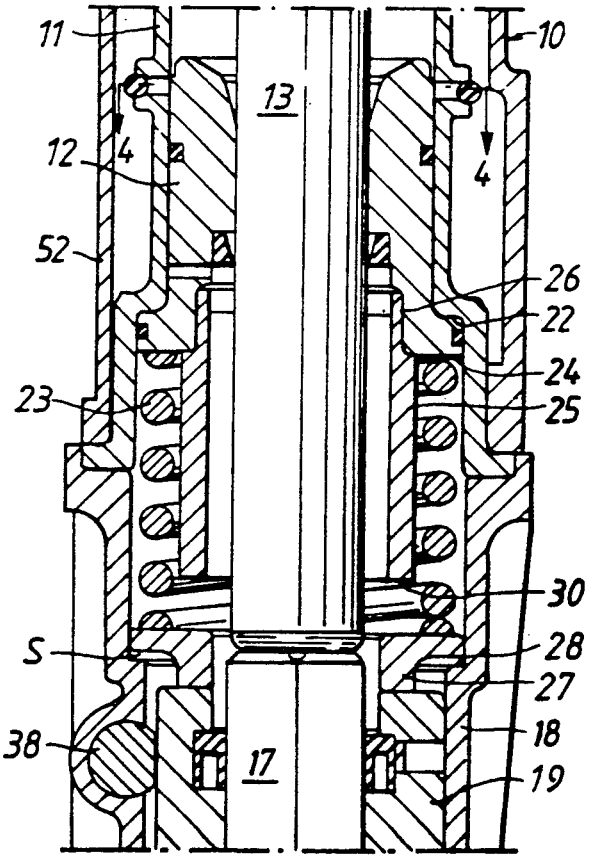
FIG. 3B shows, as a continuation of FIG. 3A, a corresponding view of the frontal part of the impact motor.

The hammer piston head 14 has an annular peripheral groove 72, FIG. 3A, carrying the piston ring 16, undivided and of wear resistant plastic material such as glass fiber reinforced PTFE(polytetrafluorethene), which seals slidably against the wall of the cylinder 11 in front of the drive piston 40. The piston ring 16 is sealed against the piston head 14 by an O-ring of preferably heat resistant rubber, which sealingly fills the gap therebetween. As an alternative, the piston head 14 may be machined to have a sealing and sliding fit in the cylinder 11, in which case the piston ring 16 and groove 27 are omitted.

Figure 4:
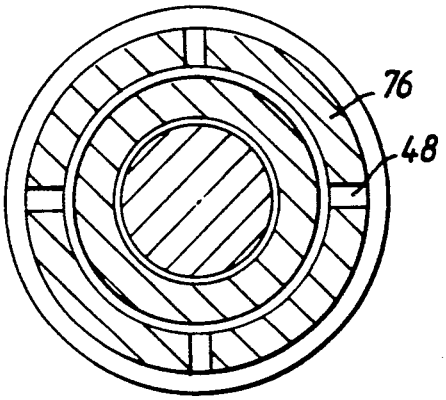
FIG. 4 is a somewhat enlarged cross section on the line 4—4 in FIG. 3B.

The machine comprises a mantle 52 with the interior thereof suitably connected to the ambient air in a way preventing the entrance of dirt into the machine. The gas cushion in the working chamber 44 transmits by way of alternating pressure rise and vacuum, i.e. by air spring action, the reciprocating movement of the drive piston 40 to the hammer piston 15 in phase with the drive generated by the motor and the crank mechanism. The working chamber 44 communicates with the interior of the machine through the wall of cylinder 11 via primary ports 45, FIG. 4, and secondary ports 46, FIG. 5. These ports 45,46 are peripherally and evenly distributed in two axially spaced planes perpendicular to the axis of the cylinder 11. The total area of the primary ports 45 is important for the idle operation of the machine and its transition from idling to impacting. The secondary ports 46 have only ventilating effect and their total area is greater, for example the double of the primary area as seen from FIGS. 4,5. Additionally there is provided a control opening 53 in the cylinder wall disposed between the lower turning point of the drive piston 40 and the primary ports 45. As seen from FIG. 2, the sealing portion of the hammer piston head 14, i.e. in the example shown the piston ring 16, in the idle position thereof is disposed intermediate the primary and secondary ports 45,46. The total ventilating area of opening 53 and primary ports 45 and the distance of the latter to the piston ring 16 are calculated and chosen such that the hammer piston 15 in its above-mentioned idle position is maintained at rest without delivering blows while the overlying gas volume is ventilated freely through the ports and opening 45,53 during reciprocation of the drive piston 40 irrespective of its frequency and the rotational speed of the motor.

When starting to work, the operator, with the motor running or off, directs by suitable handles, not shown, the machine to contact the point of attack on the working surface by the tool 20, whereby the housing 10 slides forwardly and spacing ring 27 of the recoil spring 23 abuts on the tool sleeve 19, (FIG. 2). The operator selects or starts the motor to run with a suitable rotational speed and then applies an appropriate feeding force to the machine. As a result the recoil spring 23, the pre-compression of which has to be chosen strong enough to substantially balance the weight of the machine in its FIG. 2 position, is compressed further, for example the distance S indicated in FIG. 3B, the hammer piston head 14 is displaced towards the primary ports 45, the ventilating conditions in the working chamber 44 are altered so as to create a vacuum that to begin with will suck up the hammer piston 15 at retraction of the drive piston 40. The suction simultaneously causes a complementary gas portion to enter the working chamber 44 through the control opening 53 so that a gas cushion under appropriate overpressure during the following advance of the drive piston 40 will be able to accelerate the hammer piston 15 to pound on the tool neck 17. The resultant rebound of the hammer piston 15 during normal work after each impact then will contribute to assure its return from the tool 20. Therefore, the percussive mode of operation will go on even if the feeding force is reduced and solely the weight of the machine is balancing on the tool 20. The control opening 53 is so calibrated and disposed in relation to the lower turning point of the drive piston 40 and to the primary ports 45, that the gas stream into and out of the control opening 53 in pace with the movements of the drive piston 40 maintains in the working chamber 44 the desired correct size of and shifting between the levels of overpressure and vacuum so as to assure correct repetitive delivery of impacts. The dimension and position of the control opening 53 and/or an increased number of such openings strongly influences the force of the delivered impacts. The secondary ports 46 ventilate and equalize the pressure in the volume below the piston head so that the hammer piston 15 can move without hindrance when delivering blows.

In order to return to the idle position in FIG. 2 with the drive piston 40 reciprocating and the hammer piston 15 immobile, it is necessary for the operator to raise the machine a short distance from the tool 20 so that the neck 17 momentarily is lowered relative to the hammer piston 15 causing the latter to perform an empty blow without recoil. As a result the hammer piston 15 will take the inactive position of FIG. 1, the secondary ports will ventilate the upper side of the hammer piston 15 and impacting ceases despite the continuing work of the drive piston 40. Such mode of operation is maintained even upon the machine being returned to the balanced position thereof in FIG. 2 with the hammer piston head 14 in idle position between the ports 45,46.

Below the secondary ports 46 the cylinder 11 forms a braking chamber 47 for the hammer piston head 14. The chamber 47 catches pneumatically the hammer piston 15 in response to empty blows. Blows in the void are often performed so vehemently that the damping effect of the braking chamber 47 would become insufficient or the chamber 47 would be overheated In order to cope with these effects and avoid harmful metallic bottom collisions, the bottom end 12 of the cylinder 11 is resiliently supported in the direction of impact against the action of the recoil spring 23 on which the bottom end 12 is supported by a piston head 61 formed thereon and maintained by the recoil spring 23 against an inner annular shoulder 24 on the cylinder 11. By suitably arranged sealing rings the bottom end 12 is slidably sealed against the cylinder 11 with the piston head 61 received in a cylinder chamber 60 formed at the frontal end of the cylinder 11.

When at an empty blow the damping pressure in the braking chamber 47 is increased, the bottom end 12 is displaced resiliently downwardly, FIG. 7 and opens, similarly to the function of a check valve, throttling apertures 48 provided in an annular outwardly directed collar 76 on the cylinder 11. The throttling apertures 48 are fewer than the secondary ports 46, at equal size about for example in the relation 4 to 12, and the resultant throttling, which to begin with, due to the increasing size of the gap uncovered by the annularly somewhat reduced or slanting edge 80 of the bottom end 12, allows an increasing gas flow at increased spring compression, will then finally arrest the hammer piston 15 so that compressive overheating and metallic collision are avoided. The spring returned check valve action of the bottom end 12 seals off the apertures 48 against gas return and the hammer piston 15 is kept caught in the braking chamber 47 until the vacuum condition created therein can be overcome by pressing up the tool 20 against the hammer piston 15 by application of the machine weight and of an appropriate feeding force.

The resilient downward movement of the bottom end 12 is further braked by the vacuum created in the cylinder chamber 60 above the piston head 61. At continued movement a radial passage 79 in the bottom end 12 is eventually opened to the cylinder chamber 60 filling the same with gas and thus filled, the chamber 60 then is active to brake the resilient return movement by gently returning the bottom end 12 to its original position.

The collar 76 has an annular groove 78 thereon in alignment with the apertures 48 and supporting therein an O-ring 49. The O-ring 49 covers the throttling apertures 48 and functions as a check valve with a faster valving response than provided by the bottom end 12. The ring 49 is thus able to instantly prevent return flow of gas and also inflow of oil into the braking chamber 47. At the bottom within the mantle 52 below the collar 76 there is namely provided a replenishable minor oil compartment 75 around the cylinder 11, FIG. 5, with a clearance 77 around the collar 76 level with the O-ring 49, the clearance 77 allowing oil to seep or splash up from the compartment 75 along the walls within the mantle 52 during handling of the machine. Thereby the gas ventilation from the mantle 52 through the ports 45,46 and opening 53 acts to keep the interior of cylinder 11 lubricated by aspirated airborne oil droplets.

Figure 5:
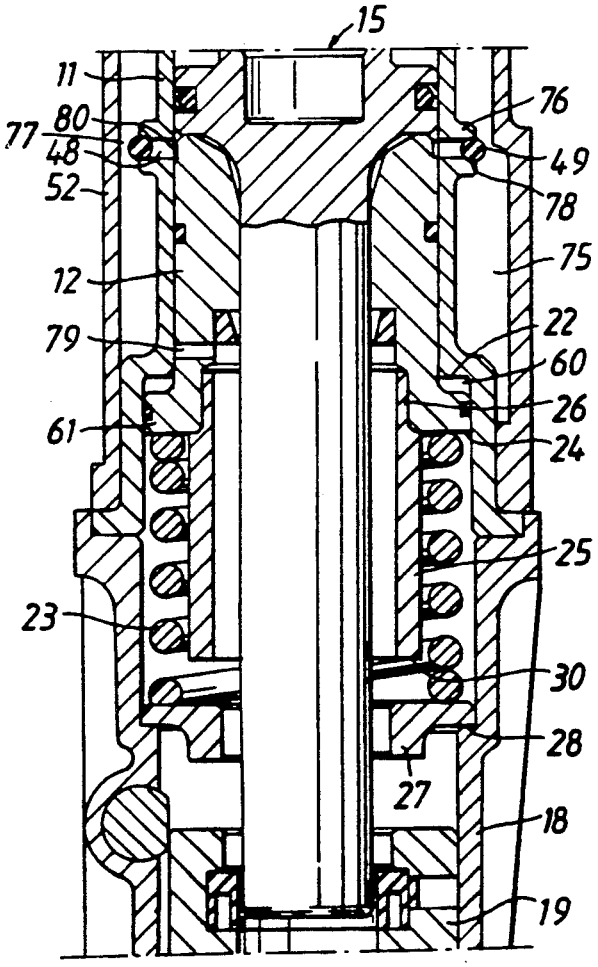
FIG. 5 corresponds to FIG. 3B but shows the hammer piston during an empty blow.

A limit stop 30 is provided on a sleeve 25 disposed around the hammer piston rod 13 inwardly of the recoil spring 23, FIG. 5. The other end 26 the sleeve 25 is connected to the bottom end 12. At maximum elastic yielding of the bottom end 12 under compression of spring 23, the limit stop 30 will abut against the spacing ring 27. Such extreme braking position, by appropriate choice of the length of sleeve 25, can bring the valving portion 80 of bottom end 12 well below the throttling apertures 48, with the hammer piston ring 16 past them sealing off completely a remaining volume in the braking chamber 47 between the hammer piston head 14 and the bottom end 12 so as to finally prevent harmful collision therebetween. It is preferred, however, to check the empty blows mainly or solely by throttling via the apertures 48 in order to reduce compressive heating. Obviously the sleeve 25 in case of need can be mounted the other way round affixed to the spacing ring 27 and act to abut the limit stop 30 against the bottom end 12 at the end of its yielding movement.

The use of the described elastically yielding bottom end 12, possessing the ability to function as a check valve, is not restricted to the above exemplified design of percussive machines but can advantageously be applied for neutralizing the empty blows also in connection with other machine tools embodying impact motors based on the application of the above as such conventional air spring drive principle.

I claim:

1. A percussive machine comprising a housing having a cylinder including a bottom end housed therein, a drive piston reciprocally movable within said cylinder for repeatedly driving a hammer piston towards said bottom end via a gas cushion in a working chamber defined in said cylinder between said drive piston and said hammer piston, said hammer piston impacting against a neck of a tool carried by said housing at said bottom end, said hammer piston being displaced towards said bottom end of said cylinder past ports defined in a wall of said cylinder through which said gas cushion in said working chamber is relieved to inactivate said hammer piston when said tool is displaced away from said bottom end to a position out of the reach of said hammer piston, said machine further including a braking chamber defined in said cylinder between said ports and said bottom end of said cylinder for pneumatically braking said displacement of said hammer piston, and means in said housing for resiliently supporting said bottom end of said cylinder to allow displacement of said bottom end relative to said cylinder in response to pneumatic pressure generated by said hammer piston in said braking chamber during said displacement of said hammer piston into said braking chamber.

2. A machine according to claim 1 including throttling apertures defined in the cylinder wall, said displacement of said bottom end uncovering said apertures for relieving said braking chamber under throttling and, subsequent to said displacement of said bottom end, closing said apertures by check valve action upon resilient return of said bottom end.

3. A machine according to claim 2 including further check valve means defined in said cylinder wall for preventing, upon said displacement of said bottom end, return flow to said braking chamber.

4. A machine according to claim 2, wherein said hammer piston is a differential piston with a piston ring on a piston head thereof for sealingly cooperating with said cylinder; said bottom end of said cylinder sealingly guiding a piston rod of said hammer piston and defining, together with said piston head, said braking chamber in said cylinder; a limit stop connected to said bottom end for engaging cooperating stop means in said housing for limiting said displacement of said bottom end; and said piston ring being movable past said apertures in said cylinder for completely closing said braking chamber before said limit stop engages said stop means in said housing.

5. A machine according to claim 1 including a supporting piston head extending from said bottom end of said cylinder, said supporting piston head cooperating with a cylinder chamber defined in said housing for permitting entry of gas to fill said cylinder chamber during said displacement of said bottom end to check the resilient return movement of said bottom end.

6. A machine according to claim 1 wherein said means in said housing for resiliently supporting said bottom end of said cylinder includes a recoil spring, said recoil spring transmitting a feeding force to said tool during operation of the machine and resting on a fixed support in said housing when said tool is in said position out of reach of said hammer piston.

7. A machine according to claim 1, wherein said hammer piston (150 is a differential piston (15), said bottom end (12) of said cylinder (11) sealingly guides a piston rod (13) on said differential hammer piston (150 and encloses together with a head (14) of said hammer piston (15) said braking chamber (47) in said cylinder (11).

8. A machine according to claim 1, including a limit stop operatively associated with said bottom end of said cylinder for engaging against said housing for limiting said displacement of said bottom end.

* * * * *